US011821612B2

(12) United States Patent
Morrow

(10) Patent No.: US 11,821,612 B2
(45) Date of Patent: Nov. 21, 2023

(54) ACCESSORY ARTICULATING MOUNT ATTACHMENT APPARATUS

(71) Applicant: ALMO GLOBAL PTY LIMITED, Dulwich Hill (AU)

(72) Inventor: Alexander Morrow, Dulwich Hill (AU)

(73) Assignee: ALMO GLOBAL PTY LIMITED, Dulwich Hill (AU)

( * ) Notice: Subject to any disclaimer, the term of this patent is extended or adjusted under 35 U.S.C. 154(b) by 0 days.

(21) Appl. No.: 17/998,475

(22) PCT Filed: May 12, 2021

(86) PCT No.: PCT/AU2021/050440
§ 371 (c)(1),
(2) Date: Nov. 10, 2022

(87) PCT Pub. No.: WO2021/226667
PCT Pub. Date: Nov. 18, 2021

(65) Prior Publication Data

US 2023/0243489 A1 Aug. 3, 2023

(30) Foreign Application Priority Data

May 14, 2020 (AU) ..... 2020901560

(51) Int. Cl.
*F21V 21/088* (2006.01)
*F21Y 113/10* (2016.01)
*F21Y 115/10* (2016.01)

(52) U.S. Cl.
CPC ..... *F21V 21/0885* (2013.01); *F21Y 2113/10* (2016.08); *F21Y 2115/10* (2016.08)

(58) Field of Classification Search
CPC ..... F21V 21/0885; F21V 17/10; F21V 17/16; F21V 21/084; F21V 21/088; F21V 21/08; F21V 21/14; F21V 21/145; F21V 21/30; F21V 21/32; F21V 21/34; F21V 21/00; F21V 17/00; F21V 17/02; F21Y 2113/10; F21Y 2115/10
See application file for complete search history.

(56) References Cited

U.S. PATENT DOCUMENTS 1,583,596 A * 5/1926 Lacklen ..... F21L 4/005 24/336
2,041,332 A * 5/1936 Golden ..... F21V 21/0885 248/305

(Continued)

OTHER PUBLICATIONS

International Search Report & Written Opinion dated Jul. 28, 2021 from PCT Application No. PCT/AU2021/050440.

(Continued)

*Primary Examiner* — Bao Q Truong
(74) *Attorney, Agent, or Firm* — INNOVATION CAPITAL LAW GROUP, LLP; Vic Lin

(57) ABSTRACT

Accessory attachment apparatus forms an articulating mounting attachment between a body of the accessory and an attachment. The articulating mounting attachment has an integrally formed generally cylindrical inner coupling member couplable within a conformingly generally cylindrical and open outer coupling member. The outer coupling member is rotatably engaging the inner coupling member therein along a longitudinal axis thereof.

22 Claims, 2 Drawing Sheets

(56) References Cited

U.S. PATENT DOCUMENTS

| | | | | |
|---|---|---|---|---|
| 5,180,223 | A | 1/1993 | McNamee | |
| 6,953,259 | B2 * | 10/2005 | Parsons | F21V 21/0885 362/396 |
| 7,101,103 | B1 * | 9/2006 | Dietz | F21V 21/0885 362/118 |
| 8,545,041 | B2 * | 10/2013 | Brown | F21V 21/0885 24/336 |
| 9,161,586 | B2 * | 10/2015 | Brown | F21V 21/0885 |
| 10,863,879 | B2 * | 12/2020 | Cullins | F21V 21/0885 |
| 2013/0241391 | A1 | 9/2013 | Takei | |
| 2016/0025309 | A1 | 1/2016 | Zhang | |
| 2017/0343167 | A1 | 11/2017 | Petluri et al. | |

OTHER PUBLICATIONS

International-type search report dated Mar. 25, 2021 from AU application No. 2020901560.

* cited by examiner

ACCESSORY ARTICULATING MOUNT ATTACHMENT APPARATUS

FIELD OF THE INVENTION

This invention relates generally to articulating mount attachment apparatus for attaching various accessories (such as lighting units and the like) to various electronic devices (such as mobile phones, laptop screens and the like).

SUMMARY OF THE DISCLOSURE

There is provided herein accessory attachment apparatus comprising an articulating mounting attachment between a body of the accessory and an attachment comprising an integrally formed generally cylindrical inner coupling member couplable within a conformingly generally cylindrical and open outer coupling member.

The outer coupling member rotatably engages the inner coupling member therein along a longitudinal axis thereof.

The inner coupling member is preferably an incomplete cylinder having a longitudinal opening therealong which gives slight flex aiding the coupling of the coupling members.

The longitudinal opening may run parallel with a straight edge of the body and opposite the straight edge with respect to the inner coupling member.

The outer coupling member may similarly be an incomplete cylinder having a longitudinal opening therealong having curved side walls substantially of uniform thickness which allows the coupling member to open slightly when engaging the inner coupling member.

The inner and outer coupling members may be engageable or disengageable by sliding the inner coupling member along the longitudinal axis with respect to the outer coupling member.

The inner coupling member preferably tapers towards either end thereof so that friction increases between the inner coupling member and the outer coupling member as a midpoint along the inner coupling member moves towards a midpoint along the outer coupling member.

The apparatus may further comprise a detent between the outer coupling member and the inner coupling member operative when the midpoints coincide to assist the user ascertaining when the cylindrical coupling members may be correctly aligned.

The accessory may be portable lighting apparatus comprising a portable light unit having a generally rectangular body comprising a generally planar diffusive screen on a front face thereof, the screen having a plurality of LEDs therebehind, control circuitry and a battery power supply for the LEDs.

The LEDs may comprise a matrix of 2-in-1 bi-colour LEDs. The matrix of bi-colour LEDs (as opposed to a matrix of separate LEDs of different colours) allows the colour of the lighting unit to be adjusted (such as cool white, daylight, tungsten and the like) whilst reducing lighting differential offset which could affect shadows.

The inner coupling member may run parallel a straight edge of the body. The inner coupling member may have a length less than that of the straight edge and may have a length more than half that of the straight edge.

The inner coupling member may be held from the straight edge of the body by a neck having a width less than that of an opening along the outer coupling member. The widths of the neck and the opening may be configured so that the inner coupling member can rotate with respect to the outer coupling member through more than 45°.

The attachment may comprise integrally formed clip tines extending oppositely from the outer coupling member which allows the attachment to be clipped to edges of mobile phones, laptop screens and the like. The clip tines can open by more than 250%.

The clip tines may bow outwardly which provides a universal fit for various types of electronic apparatus such as mobile phones, laptop screens and the like.

Distal inner faces of the clip tines may comprise frictional pads which enhances frictional engagement without affecting the universal fit.

The clip tines may define a proximal channel having a width greater than a thickness of the body which allows the accessory to be held between the clip members when the attachment is not required.

The proximal channel may be defined by distal engagement edges which grip edges of the accessory when the accessory is held between the clip members).

Each clip tine may be generally rectangular in a cross-section coplanar with the longitudinal axis.

At least one of the clip tines may comprise an aperture therethrough which this allows the clip to be attached centrally to a laptop screen whilst allowing an aperture for a view of a web camera through the aperture.

The attachment may alternatively comprise a base having a plate held from the outer coupling member by a pedestal and defining side edges designed to slide into respective side channels of the shoe. The plate may comprise an inferior ¼"-20 thread mount to engage a corresponding thread on a tripod or light stand.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 7:
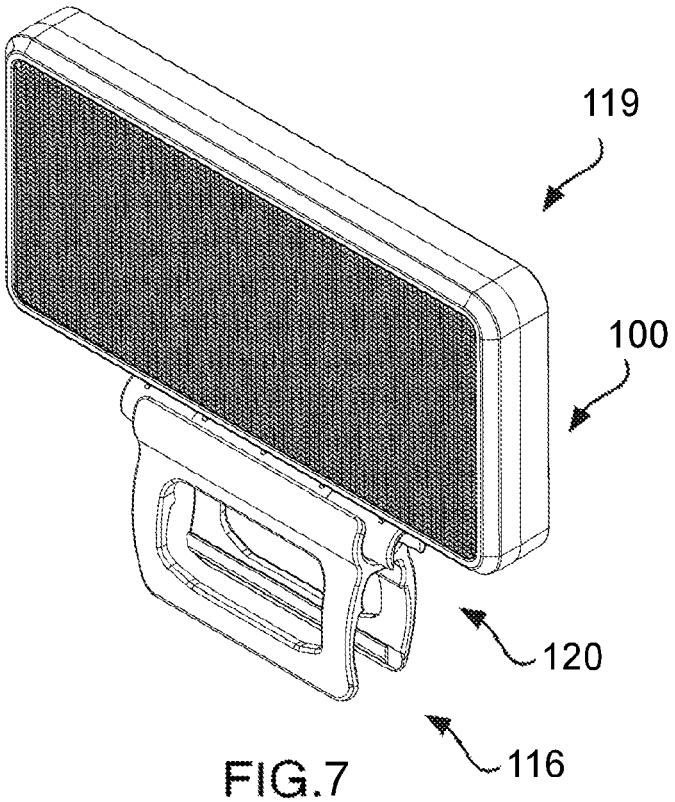
FIG. 7 shows the apparatus wherein the outer and inner coupling members are connected together to form an articulating mounting attachment.

With reference to FIG. 7, accessory 100 attachment apparatus 119 comprises an articulating mounting attachment 120 between a body 102 of the accessory 100 and an attachment 116 comprising an integrally formed generally cylindrical inner coupling member 104 couplable within a conformably generally cylindrical and open outer coupling member 105. In the embodiment shown, the body 102 comprises the inner coupling member 104 and the attachment 116 comprises the outer coupling member 105.

The outer coupling member 105 rotatably engages the inner coupling member 104 therealong a longitudinal axis 117 thereof.

The inner coupling member 104 is preferably an incomplete cylinder having a longitudinal opening 109 therealong which gives slight flex, aiding the coupling of the coupling members 104, 105.

Figure 1:
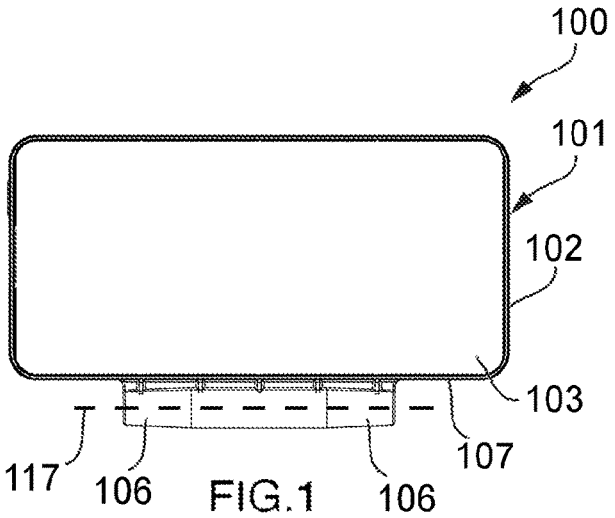
FIG. 1 shows a front elevation view of an accessory having an inner coupling member of an articulating mounting attachment.

With reference to FIG. 1, the longitudinal opening 109 preferably runs parallel with a straight edge 107 of the body 102 and opposite the straight edge 107 with respect to the inner coupling member 104.

Figure 4:
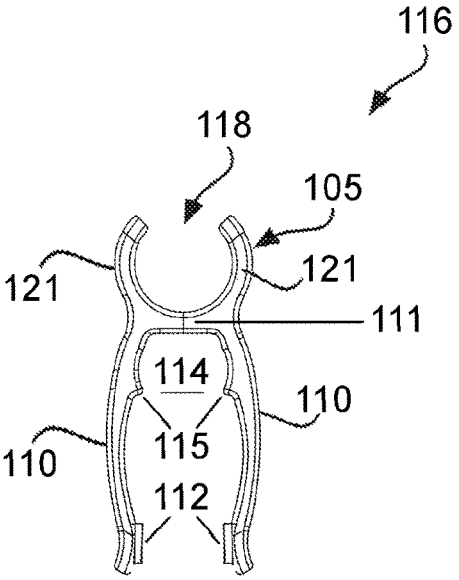
FIG. 4 shows an end elevation view of the attachment of FIG. 3.
Figure 5:
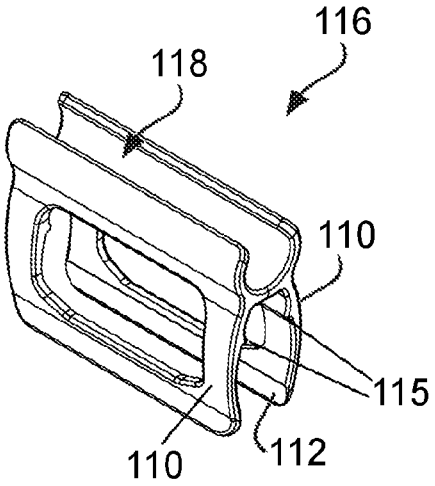
FIG. 5 shows a perspective view of the attachment of FIG. 3.

Referencing FIG. 4, the outer coupling member 105 is similarly preferably an incomplete cylinder having a longitudinal opening 118 therealong and which has curved side walls 121 substantially of uniform thickness.

The inner coupling member 104 and the outer coupling member 105 may be engageable or disengageable by sliding the inner coupling member 104 along longitudinal axis 117 with respect to the outer coupling member 105.

As shown in FIG. 1, the inner coupling member 104 preferably tapers towards either end 106 thereof so that friction increases between the inner coupling member 104 and the outer coupling member 105 as a midpoint along the inner coupling member 104 moved towards a midpoint along the outer coupling member 105.

The apparatus 119 may comprise a detent between the outer coupling member 105 and the inner coupling member 104 operative when midpoints coincide.

The accessory 100 is preferably portable lighting apparatus comprising a portable light unit 101 having a generally rectangular body comprising a generally planar diffusive screen 103 on a front face thereof. The screen 103 has a plurality of LEDs therebehind, control circuitry and a battery supply for the LEDs.

The LEDs may comprise a matrix of 2-in-1 bi-colour LEDs. The use of a matrix of bi-colour LEDs (as opposed to a matrix of separate LEDs of different colours) allows the colour of the lighting unit to be adjusted (such as cool white, daylight, tungsten and the like) whilst reducing lighting differential offset which could affect shadow.

As shown in FIG. 1, the inner coupling member 104 may run parallel the straight edge 107 of the body 102 and may have a length less than that of the straight edge 107.

Figure 2:
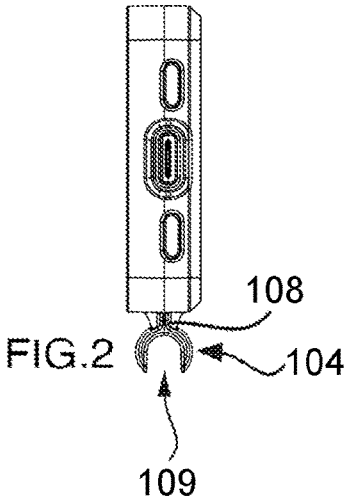
FIG. 2 shows a side elevation view of the accessory of FIG. 1.

As shown in FIG. 2, the inner coupling member 104 may be held from the straight edge 107 of the body 102 by a neck 108 having a width less than that of the opening 118 of the outer coupling member 105. The widths of the neck 108 and the opening 118 may be configured such that the accessory 100 can be positioned up to 45° with respect to the attachment 116.

Referencing FIG. 4, the attachment 116 may comprise integrally formed clip tines 110 extending oppositely from the outer coupling member 105. As such, the attachment 116 can be clipped to edges of mobile phones, laptop screens and the like using the clip tines 110. Preferably, the clip tines 110 can open by 250% or more.

The clip tines 110 may be connected by a narrow section 111 therebetween.

The clip tines 110 may bow outwardly as shown in FIG. 4, thereby providing a universal fit for various types of electronic apparatus such as mobile phones, laptop screens and the like.

Furthermore, a distal inner face of the clip tines 110 may comprise frictional pads 112 enhancing frictional engagement without affecting the universal fit.

The clip tines 110 may define a proximal channel 114 having a width greater than a thickness of the body 102. As such, the accessory 100 can be held between the clip members 110 when the attachment 116 is not required. The proximal channel 114 may be defined by distal engagement edges 115 which help grip edges of the accessory 100 when the accessory 100 is held between the clip members 110.

Figure 3:
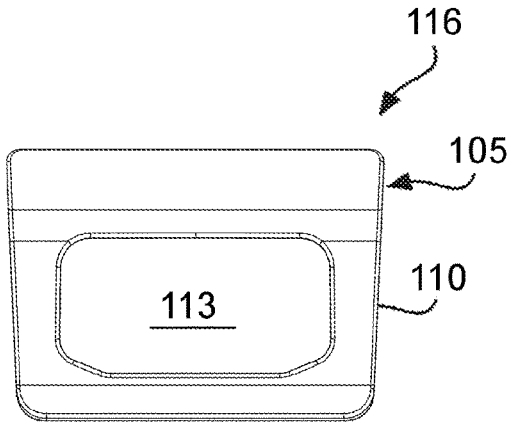
FIG. 3 shows a front elevation view of an attachment having an open outer coupling member in accordance with an embodiment.

Referencing FIG. 3, each clip tine 110 may be generally rectangular in a cross-section coplanar with the longitudinal axis 117.

Furthermore, the clip tines 110 may comprise an aperture 113 therethrough allowing the attachment 116 to be attached centrally to a laptop screen wherein the aperture 113 allows for the view of a web camera therethrough.

Figure 6:
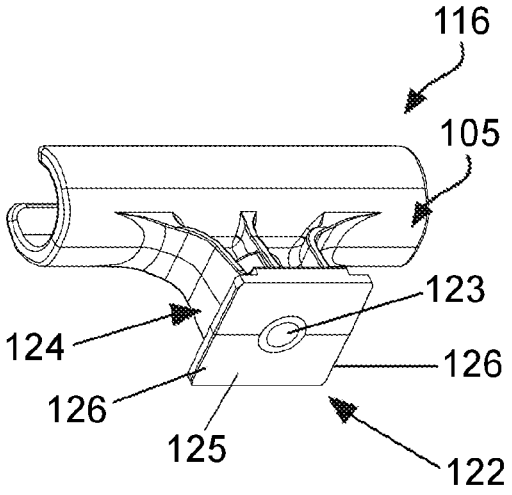
FIG. 6 shows an underside perspective view of an attachment comprising the open outer coupling member and the base configured for attachment to a camera hot shoe in accordance with an embodiment.

FIG. 6 shows an embodiment wherein the attachment 116 is designed to slide into a camera flash hot shoe. In accordance with this embodiment, the attachment 116 comprises a base 122 having a plate 125 held from the outer coupling member 105 by a pedestal 124 and defining side edges 126 which slide into respective side channels of the shoe. The plate 125 may comprise an inferior ¼"-20 thread mount 123 to engage a corresponding thread on a tripod or light stand.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The term "approximately" or similar as used herein should be construed as being within 10% of the value stated unless otherwise indicated.

The invention claimed is:

1. Accessory (100) attachment apparatus (119) comprising:

an articulating mounting attachment (120) between a body (102) of the accessory (100) and an attachment (116) comprising:

an integrally formed generally cylindrical inner coupling member (104) couplable within a conformingly generally cylindrical and open outer coupling member (105), the outer coupling member (105) rotatably engaging the inner coupling member (104) therein along a longitudinal axis (117) thereof and wherein:

the inner coupling member (104) is an incomplete cylinder having a longitudinal opening (109) therealong.

2. The apparatus as claimed in claim 1, wherein the longitudinal opening (109) runs parallel with a straight edge (107) of the body (102) and opposite the straight edge (107) with respect to the inner coupling member (104).

3. The apparatus as claimed in claim 1, wherein the outer coupling member (105) is an incomplete cylinder having a longitudinal opening (118) therealong having curved side walls substantially of uniform thickness.

4. The apparatus as claimed in claim 1, wherein:

the inner and outer coupling members (104, 105) are engageable or disengageable by sliding the inner coupling member (104) along the longitudinal axis (117) with respect to the outer coupling member; and the inner coupling member (104) tapers towards either end (106) thereof so that friction increases between the inner coupling member (104) and the outer coupling member (105) as a midpoint along the inner coupling member (104) moves towards a midpoint along the outer coupling member (105).

5. The apparatus as claimed in claim 4, further comprising a detent between the outer coupling member (105) and the inner coupling member (104) operative when the midpoints coincide.

6. The apparatus as claimed in claim 1, wherein the accessory (100) is portable lighting apparatus comprising:

a portable light unit (101) having a generally rectangular body (102) comprising a generally planar diffusive screen (103) on a front face thereof, the screen (103) having a plurality of LEDs therebehind, control circuitry and a battery power supply for the LEDs.

7. The apparatus as claimed in claim 6, wherein the LEDs comprise a matrix of 2-in-1 bi-colour LEDs.

8. The apparatus as claimed in claim 1, wherein the inner coupling member (104) runs parallel a straight edge (107) of the body (102).

9. The apparatus as claimed in claim 8, wherein the inner coupling member (104) has a length less than that of the straight edge (107).

10. The apparatus as claimed in claim 8, wherein the inner coupling member (104) has a length more than half that of the straight edge (107).

11. The apparatus as claimed in claim 1, wherein the inner coupling member is held from the straight edge of the body by a neck (108) having a width less than that of an opening (118) along the outer coupling member (105).

12. The apparatus as claimed in claim 11, wherein the widths of the neck (108) and the opening (119) are configured so that the inner coupling member (104) can rotate with respect to the outer coupling member (105) through more than 45°.

13. The apparatus as claimed in claim 1, wherein the attachment (116) comprises integrally formed clip tines (110) extending oppositely from the outer coupling member (105).

14. The apparatus as claimed in claim 13, wherein the clip tines can open by more than 250%.

15. The apparatus as claimed in claim 13, wherein the clip tines (110) bow outwardly.

16. The apparatus as claimed in claim 15, wherein distal inner faces of the clip tines (110) comprise frictional pads (112).

17. The apparatus as claimed in claim 13, wherein the clip tines (110) define a proximal channel (114) having a width greater than a thickness of the body.

18. The apparatus as claimed in claim 17, wherein the proximal channel (114) defines distal engagement edges (115).

19. The apparatus as claimed in claim 13, wherein each clip tine (110) is generally rectangular in a cross-section coplanar with the longitudinal axis.

20. The apparatus as claimed in claim 13, wherein at least one of the clip tines comprises an aperture (113) therethrough.

21. The apparatus as claimed in claim 1, wherein the attachment (116) comprises a base (122) having a plate (125) held from the outer coupling member (105) by a pedestal (124) and defining side edges (126) designed to slide into respective side channels of the shoe.

22. The apparatus as claimed in claim 21, wherein the plate (125) comprises an inferior thread mount (123) to engage a corresponding thread on a tripod or light stand.

* * * * *